United States Patent [19]

Franke

[11] 4,082,954

[45] Apr. 4, 1978

[54] X-RAY DIAGNOSTIC GENERATOR

[75] Inventor: Kurt Franke, Erlangen, Germany

[73] Assignee: Siemens Aktiengesellschaft, Berlin & Munich, Germany

[21] Appl. No.: 624,169

[22] Filed: Oct. 20, 1975

[30] Foreign Application Priority Data

Oct. 23, 1974 Germany ..... 2450428

[51] Int. Cl.[2] ..... H05G 1/56

[52] U.S. Cl. ..... 250/421; 250/415

[58] Field of Search ..... 250/415, 421

[56] References Cited

U.S. PATENT DOCUMENTS 3,075,082 1/1963 Kiesel ..... 250/415

FOREIGN PATENT DOCUMENTS 1,128,929 5/1962 Germany ..... 250/421

*Primary Examiner*—Alfred E. Smith
*Assistant Examiner*—T. N. Grigsby
*Attorney, Agent, or Firm*—Hill, Gross, Simpson, Van Santen, Steadman, Chiara & Simpson

[57] ABSTRACT

An X-ray diagnostic generator in which the voltage demands on the rectifier in the high-voltage circuit are essentially lower than in the present state of the art in that the circuit arrangement is located in the primary circuit of the high-voltage transformer. The circuit arrangement for the automatic determination of the starting timepoint for the X-ray tube may be arranged in the primary circuit of the high-voltage transformer, so that the rectifier in the secondary circuit thus serves only for effecting the regulation of the X-ray tube voltage. Consequently, in this instance, the rectifier need be dimensioned for only a voltage which is obtained from the fluctuations of the X-ray tube voltage.

1 Claim, 2 Drawing Figures

X-RAY DIAGNOSTIC GENERATOR

FIELD OF THE INVENTION

The present invention relates to an X-ray diagnostic generator.

DISCUSSION OF THE PRIOR ART

An X-ray diagnostic generator is known in the art wherein a regulatable rectifier is arranged in the secondary circuit of a high-voltage transformer, and which serves for the switching in-and-out or starting and stopping of the X-ray tube voltage, as well as for the regulation of this voltage. The rectifier must be dimensioned for maximum X-ray tube voltage inasmuch as the X-ray tube voltage is present at the rectifier at the switch-off or stopping moment. Since X-ray tube voltages which are of the magnitude of 150 kV are employed in diagnosis, the rectifier must be constructed so as to be able to withstand such voltages.

SUMMARY OF THE INVENTION

Accordingly, it is an object of the present invention to provide an X-ray diagnostic generator of the above-mentioned type, in which the voltage demands on the rectifier in the high-voltage circuit are essentially lower than in the present state of the art.

The foregoing object is inventively achieved in that the circuit arrangement is located in the primary circuit of the high-voltage transformer. The invention is predicated on the knowledge that when, by means of the X-ray diagnostic generator, there is no preparation of any short-term exposures and no exposures series having a high picture frequency, the circuit arrangement for the automatic determination of the starting timepoint for the X-ray tube may be arranged in the primary circuit of the high-voltage transformer, so that the rectifier in the secondary circuit thus serves only for effecting the regulation of the X-ray tube voltage. Consequently, in this instance, the rectifier need be dimensioned for only a voltage which is obtained from the fluctuations of the X-ray tube voltage.

In the known X-ray diagnostic generator, a switch is provided in the primary circuit. However, this switch does not serve for the automatic determination of the starting time of the X-ray tubes but is a main switch which is actuated by hand and is closed for setting the X-ray diagnostic generator into operation.

BRIEF DESCRIPTION OF THE DRAWINGS

Further advantages and details of the invention may now be ascertained from the following description of two exemplary embodiments thereof, taken in conjunction with the accompanying drawings; in which.

DETAILED DESCRIPTION

Figure 1:
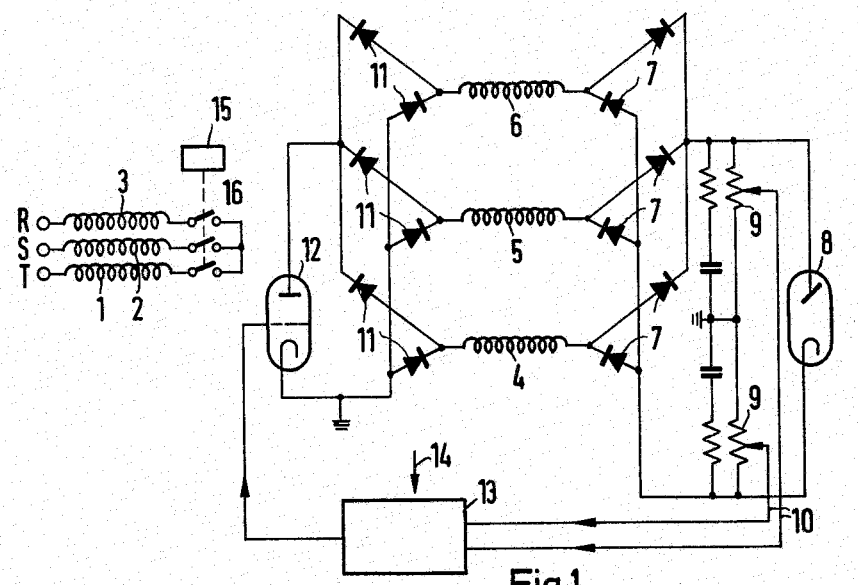
FIG. 1 schematically illustrates a polyphase alternating current X-ray diagnostic generator in a six-pulse circuit.

Referring now in detail to the drawings, illustrated in FIG. 1 is a polyphase X-ray diagnostic generator in a six-pulse circuit which contains a high-voltage transformer having three primary windings 1 through 3 and three secondary windings 4 through 6. The windings 1 through 3 and 4 through 6 are connected in a star. Connected to one of the ends of the secondary windings 4 through 6 is a polyphase or rotary current high-voltage rectifier 7 in a bridge circuit, which supplies an X-ray tube 8. Located in parallel with the cathode-anode section of the X-ray tube 8 is a voltage divider 9 which is symmetrical to ground, having branched or tapped off therefrom a voltage lying between the connectors 10 and which embodies the X-ray tube voltage.

Connected with the second ends of the secondary windings 4 through 6 is a second rotary current rectifier bridge 11 having an electrical valve or a regulating rectifier 12 located in the direct or continuous current branch thereof. The grid of the regulating rectifier 12 has a control voltage transmitted thereto from a comparator 13.

The comparator 13 compares the voltage between the connectors 10, which embodies the actual value of the X-ray tube voltage, with the voltage at the reference value input 14 and which represents the reference value of the X-ray tube voltage, and so adjusts the grid supply voltage of the regulating rectifier 12 as to maintain the X-ray tube voltage at the reference value. The comparator 13 is formed by a differential or sum-and-difference amplifier.

For effecting the automatic determination of the starting timepoint of the X-ray tube 8, there is provided an electronic timer switch installation 15 through the intermediary of which there are actuatable the contacts 16 in the primary circuit of the high-voltage transformer. By means of the contacts 16, one of the ends of the primary windings 1 through 3 are connected with each other so as to thereby complete the star connection.

When it is assumed in the circuit of FIG. 1 that the supply voltage is constant then, through intermediary of the regulating triode 12 there must be compensated only the pulsations of the X-ray tube voltage. For the voltage loading U on the regulating triode 12, in this instance, at a maximum X-ray tube voltage of 130 kV the following is of effect:

$$U = 130\text{ kV}\,(1 - \cos 30°) \approx 17\text{ kV}.$$

Considering a power supply voltage fluctuation of ± 10%, then the following is effective for the voltage loading on the regulating triode 12:

$$U = 0.2 \cdot 130\text{ kV} + 17\text{ kV} = 43\text{ kV}.$$

In the X-ray diagnostic generator pursuant to FIG. 1 it is thus adequate to utilize a regulating triode which is designed for a voltage load of about 50 kV, since the determination of the starting timepoint for the X-ray tube 8 is carried out by means of a switching element which is arranged in the primary circuit of the high-voltage transformer.

Figure 2:
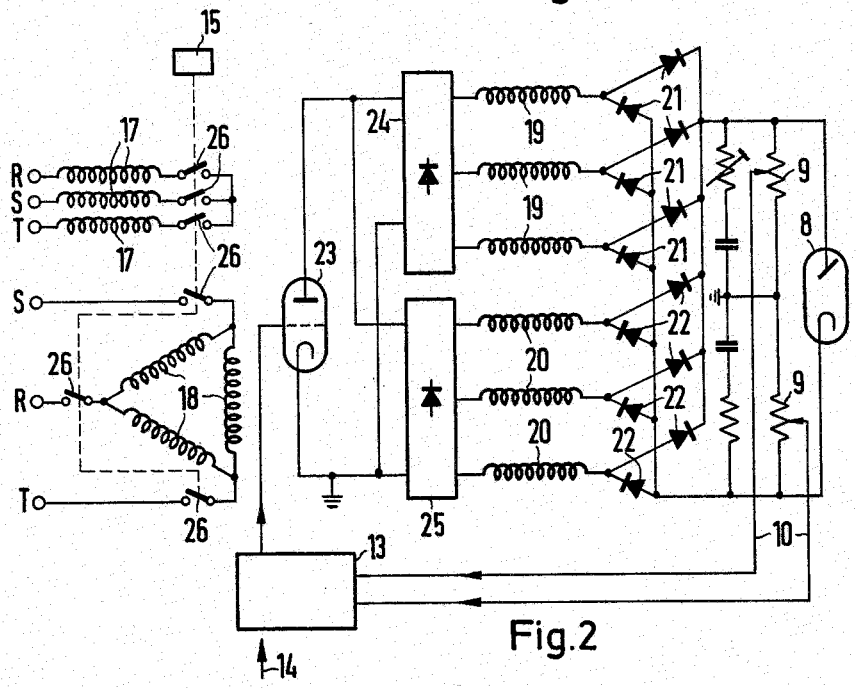
FIG. 2 is a polyphase alternating current X-ray diagnostic generator, similar to that of FIG. 1, in a twelve-pulse circuit.

Still more advantageous are the relationships obtained in the X-ray diagnostic generator constructed pursuant to FIG. 2 (12-pulse circuit). This X-ray diagnostic generator contains a first primary winding group 17 in a star circuit, and a second primary winding group 18 in a triangular circuit. The generator further contains two secondary winding groups 19 and 20 in a star circuit. The secondary winding group 19 is connected to a polyphase or rotary current rectifier bridge 21 and the secondary winding group 20 to a polyphase or rotary current rectifier bridge 22. The rectifier bridges 21 and 22 are connected in series with each other and supply the X-ray tube 8. In this example, the voltage between the connectors 10 which embodies the X-ray tube is also tapped off at the voltage divider 9 and transmitted to the comparator element 13.

The secondary winding group 19 is connected to a second polyphase rotary current rectifier bridge 24, and the secondary winding group 20 to a second polyphase rectifier bridge 25. The positive pole of the direct-current branches of the rectifiers 24 and 25 are connected to the anode, and the negative poles of these rectifier bridges to the cathode of the regulating triode 23, so that the regulating triode 23, as in the example pursuant to FIG. 1, represents a series resistance to the X-ray tube 8 and thereby determines the X-ray tube voltage. While considering a supply voltage fluctuation of ± 10% and a maximum X-ray tube voltage of 130 kV, there is thus obtained for the voltage load on the regulating triode 23 in the exemplary embodiment according to FIG. 2, the following:

$$U = 0.2 \cdot 130\,\text{kV} + 130\,\text{kV}\,(1 - \cos 15°) = 20\,\text{kV}.$$

The voltage load in the twelve-pulse circuit pursuant to FIG. 2 thus is essentially lower than that in the six-pulse circuit according to FIG. 1. In the circuit of FIG. 2 there similarly is provided an electronic timer switch installation 15, which, in this instance, actuates six contacts 26 for the automatic determination of the starting timepoint for the X-ray tube 8.

The inventive X-ray diagnostic generator is particularly suitable for purposes of measurement, for example, for the measurement of the absorption of X-rays by an object. Within the scope of the invention it is, however, also possible to operate radiological exposures by means of the time switch installation 15. Furthermore, the timer switch installation 15 may also be replaced by an automatic exposure timer, or by means of an mAs-relay.

While there has been shown what is considered to be the preferred embodiment of the invention, it will be obvious that modifications may be made which come within the scope of the disclosure of the specification.

What is claimed is:

1. In an X-ray diagnostic generator including a high-voltage transformer; a high-voltage rectifier for supplying the X-ray tube of said generator being connected to the output of said high-voltage transformer; a regulating rectifier for the X-ray tube voltage being arranged in the high-voltage circuit; a comparator for the actual and reference values of the X-ray tube voltage being connected to a control electrode of said regulating rectifier; and switch means for the automatic determination of the starting time for the X-ray tube, the improvement comprising: said switch means being located in the primary circuit of said high-voltage transformer; Polyphase alternating current high-voltage transformer in a twelve-pulse connection including two secondary winding groups each having three secondary windings and two polyphase alternating current rectifier bridges each connected to one of the ends of the secondary windings of a secondary winding group, both rectifier bridges being connected in series and supplying said X-ray tube; and a further polyphase alternating current rectifier being provided for each said secondary winding group and connected to the second ends of the corresponding secondary windings, the positive poles of the direct-current branches of said rectifiers being connected to the anode and the negative poles being connected to the cathode of said regulating rectifier.

* * * * *